US007140598B2

(12) United States Patent
Verakis et al.

(10) Patent No.: US 7,140,598 B2
(45) Date of Patent: Nov. 28, 2006

(54) FREEFALL WINDLASS WITH GOVERNOR

(75) Inventors: David C. Verakis, Florence, KY (US); David C. McBreen, Cincinnati, OH (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 102 days.

(21) Appl. No.: 10/996,281

(22) Filed: Nov. 22, 2004

(65) Prior Publication Data

US 2006/0108571 A1 May 25, 2006

(51) Int. Cl.
*B66D 1/14* (2006.01)

(52) U.S. Cl. ..... 254/345

(58) Field of Classification Search ..... 254/345, 254/346, 347

See application file for complete search history.

(56) References Cited

U.S. PATENT DOCUMENTS

| | | | | |
|---|---|---|---|---|
| 2,700,531 | A * | 1/1955 | Patterson, Jr. | 254/346 |
| 3,687,249 | A * | 8/1972 | Priest et al. | 192/215 |
| 4,004,780 | A * | 1/1977 | Kuzarov | 254/345 |
| 4,588,167 | A * | 5/1986 | Finzel | 254/346 |
| 4,809,633 | A | 3/1989 | Santos | |
| RE33,898 | E * | 4/1992 | Santos | 114/210 |
| 5,697,599 | A * | 12/1997 | Lamb | 254/328 |

* cited by examiner

*Primary Examiner*—Emmanuel M Marcelo
(74) *Attorney, Agent, or Firm*—Dorsey & Whitney LLP

(57) ABSTRACT

A freefall-type windlass includes appropriate gearing for moving the windlass spool in a retrieve direction to wrap anchor cable thereabout or to permit the anchor to drop by gravity thereby unwrapping the anchor cable from the spool. A governor gear is incorporated into the windlass to restrict the rate at which the spool can rotate when the anchor is being paid out thereby avoiding entanglement of the anchor cable and malfunctioning of the windlass.

3 Claims, 7 Drawing Sheets

FREEFALL WINDLASS WITH GOVERNOR

BACKGROUND OF THE INVENTION

1. Field of the Invention

The present invention relates generally to windlasses and in particular to a windlass which is motor driven to raise an anchor or other heavy object while allowing the object to freefall in a controlled manner through use of a governor on the cable spool of the windlass.

2. Description of the Relevant Art

Recreational boats, as well as other crafts of similar size, frequently include power operated windlasses or anchor winches capable of automatically dropping, locking, or raising an anchor. Sometimes, the motor is reversible to raise the anchor or lower the anchor in a controlled manner, but many times the anchor is lowered through gravity so that the anchor freefalls through the water to its destination.

As will be appreciated, when an anchor and its cable is allowed to drop by gravity at a relatively fast speed, the cable will sometimes overrun the spool on which it is wrapped throwing the cable off the spool. When this happens, the cable can become entangled with itself leading to a malfunction of the windlass and a great deal of trouble in untangling the cable.

It would therefore be desirable to control the movement of the cable spool even in a freefall windlass so that the cable does not become entangled with itself and possibly the spool to thereby avoid malfunctioning of the windlass. It is to provide a system for controlling a freefall windlass that the present invention has been developed.

SUMMARY OF THE INVENTION

The windlass of the present invention utilizes a reversible electric motor having a gear on its drive shaft for driving a gear chain including a spool gear connected to the windlass spool. Included in the gear chain is a selectively shiftable clutch gear that moves into and out of driving engagement with the spool gear depending upon direction of rotation of the motor. These basic components of a windlass are similar to the windlass described in U.S. Pat. No. 4,809,633, the disclosure of which is hereby incorporated by reference.

In addition to the basic components mentioned, the windlass of the present invention includes a governing gear that remains in meshed relationship with the spool gear at all times but a spring biased resistance design allows the governing gear to restrict rotation of the spool gear to a desired speed. The resistance provided by the governing gear is not sufficient to override the motor when the windlass is in a retrieving mode but does restrict rotational speed of the spool gear when the anchor on the anchor cable is in a freefall or payout mode.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

Figure 1:
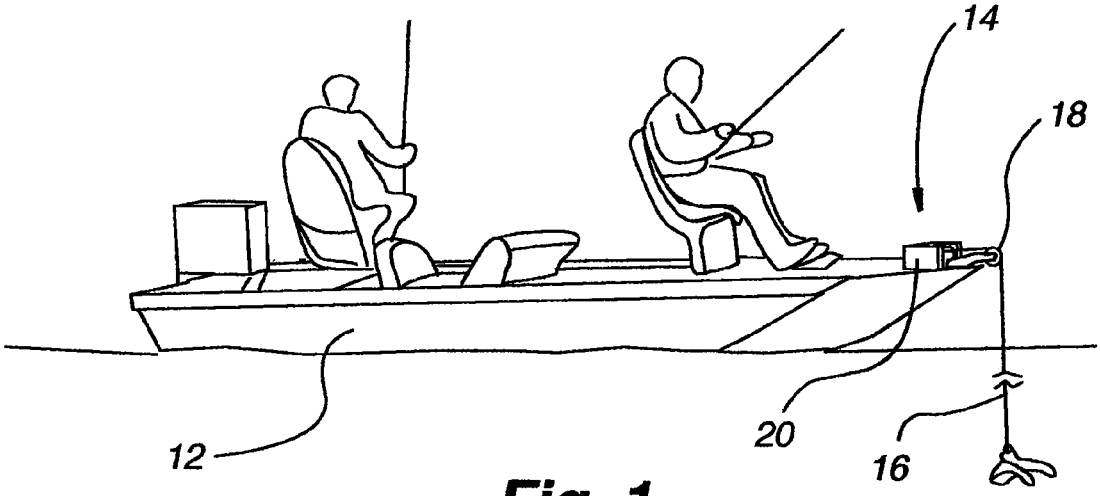
FIG. 1 is an isometric of a fishing boat having the windlass of the present invention incorporated therein.
Figure 2:
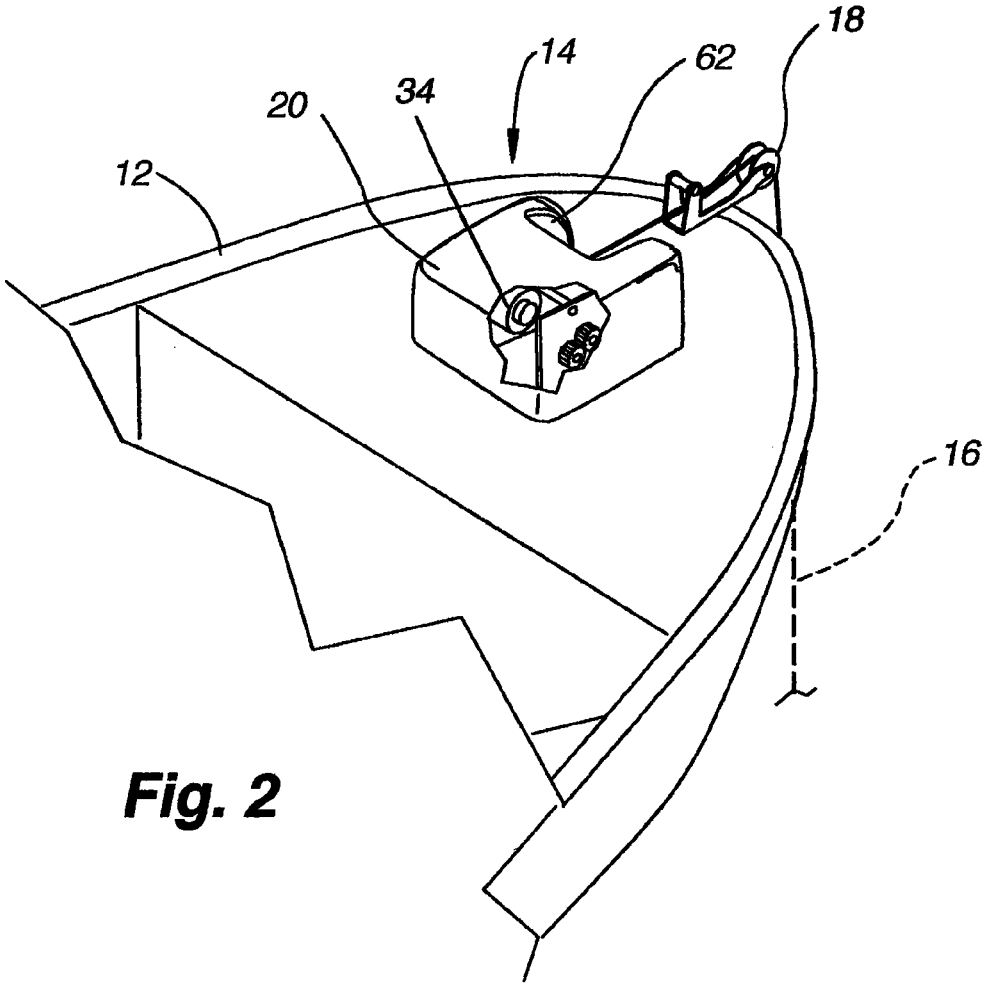
FIG. 2 is an enlarged fragmentary isometric showing the windlass on the front of the boat of FIG. 1.
Figure 3:
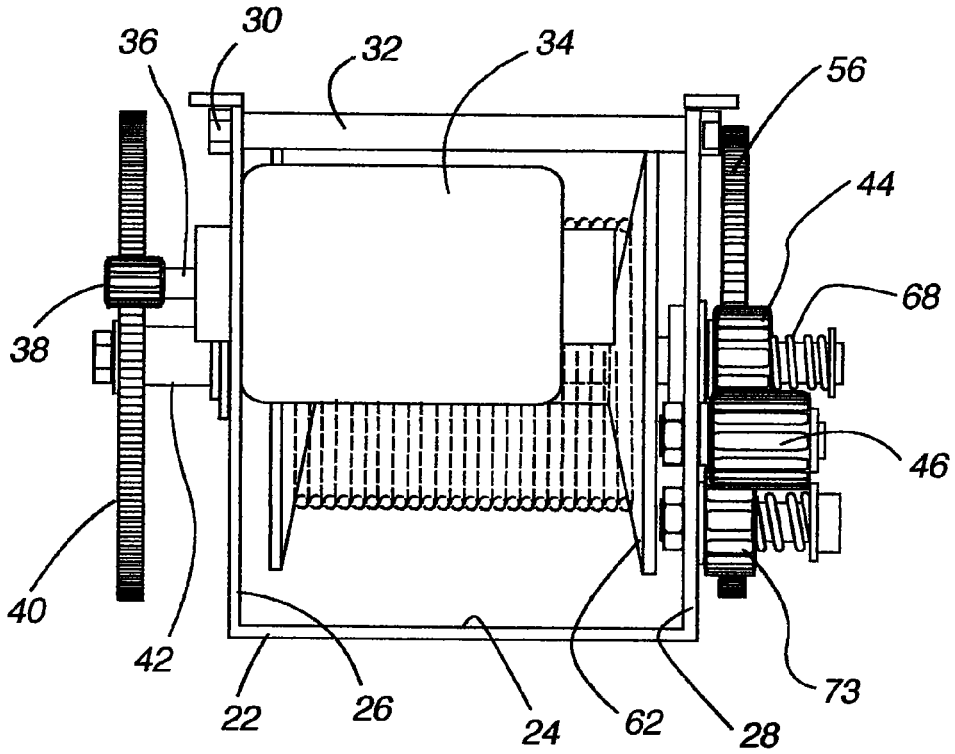
FIG. 3 is a front elevation of the windlass of the present invention without its outer housing.

With reference first to FIGS. 1 and 2, a boat 12 illustrated as a small fishing vessel includes a windlass 14 in accordance with the present invention mounted on the bow of the boat so that the anchor cable 16 emanating from the windlass can pass over a guide pulley 18 allowing the anchor to remain spaced from the boat in a conventional manner.

The windlass 14 itself as best seen in FIGS. 3–11, without an outer covering or housing 20 seen in FIGS. 1 and 2, includes a frame 22 of generally U-shaped transverse cross section having a base 24 that can be secured to the deck of the boat 12 and left and right upstanding side walls 26 and 28, respectively. The side walls are bridged along a top edge with a bolt 30 and surrounding spacer sleeve 32 to provide strength and rigidity to the frame. A reversible electric motor 34 is mounted adjacent the front and near the top of the left side wall 26 and has a drive shaft 36 protruding outwardly from the left side wall. A toggle switch (not shown) is utilized to energize/de-energize the motor or reversibly drive it in retrieve and payout directions as will become more clear later. The drive shaft for the motor has a pinion gear 38 on its distal end meshed with a relatively large transfer gear 40. The transfer gear is mounted on the left end of a transfer shaft 42 journaled in the side walls of the frame at approximately their vertical center. The opposite end of the transfer shaft carries a clutch gear 44, which will be described in more detail later. The clutch gear is meshed with a relatively wide control gear 46 having teeth longer than those of the clutch gear so that the clutch gear can move axially of the control gear while remaining in meshed relationship therewith. The control gear itself is mounted on a stub shaft 48 as probably best seen in FIGS. 10 and 11 with the stub shaft being held on the right side wall 28 of the frame with a nut 50 and washers 52 separating the nut and the control gear from the right side wall. The stub shaft, of course, has an enlarged free end 54 to confine the control gear rotatably on the stub shaft.

Figure 5:
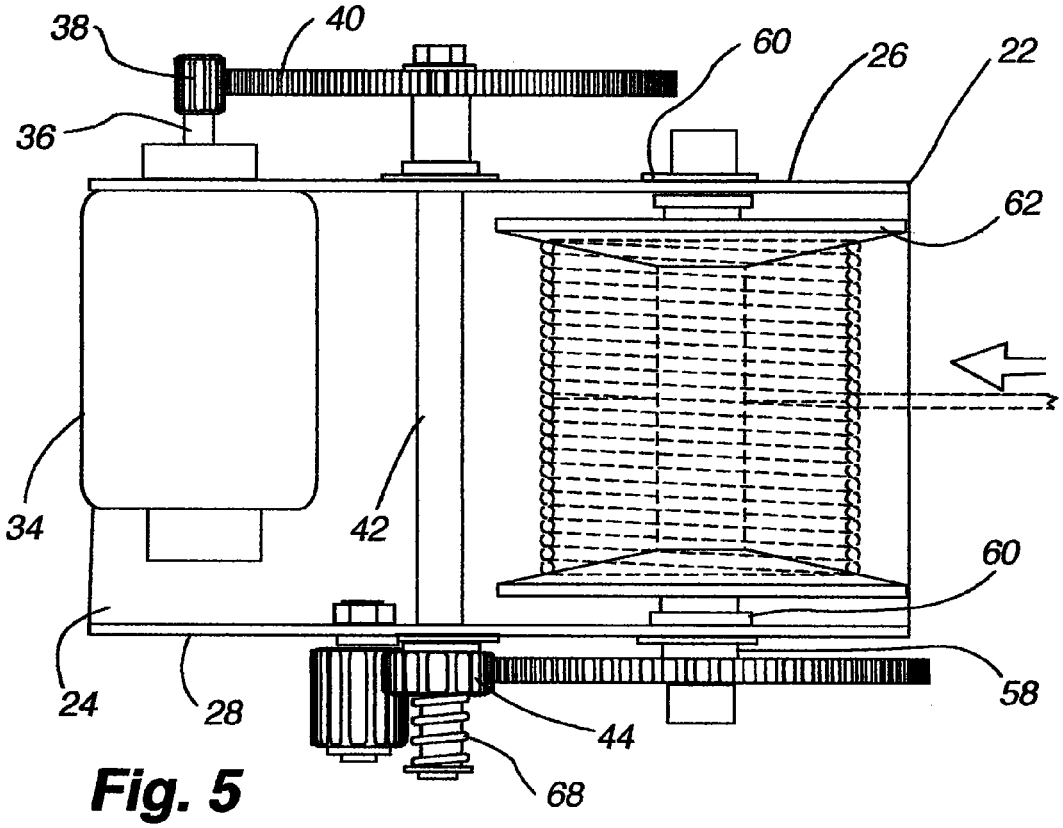
FIG. 5 is a top plan view of the windlass as shown in FIG. 3 with the clutch gear in a retrieving position.
Figure 6:
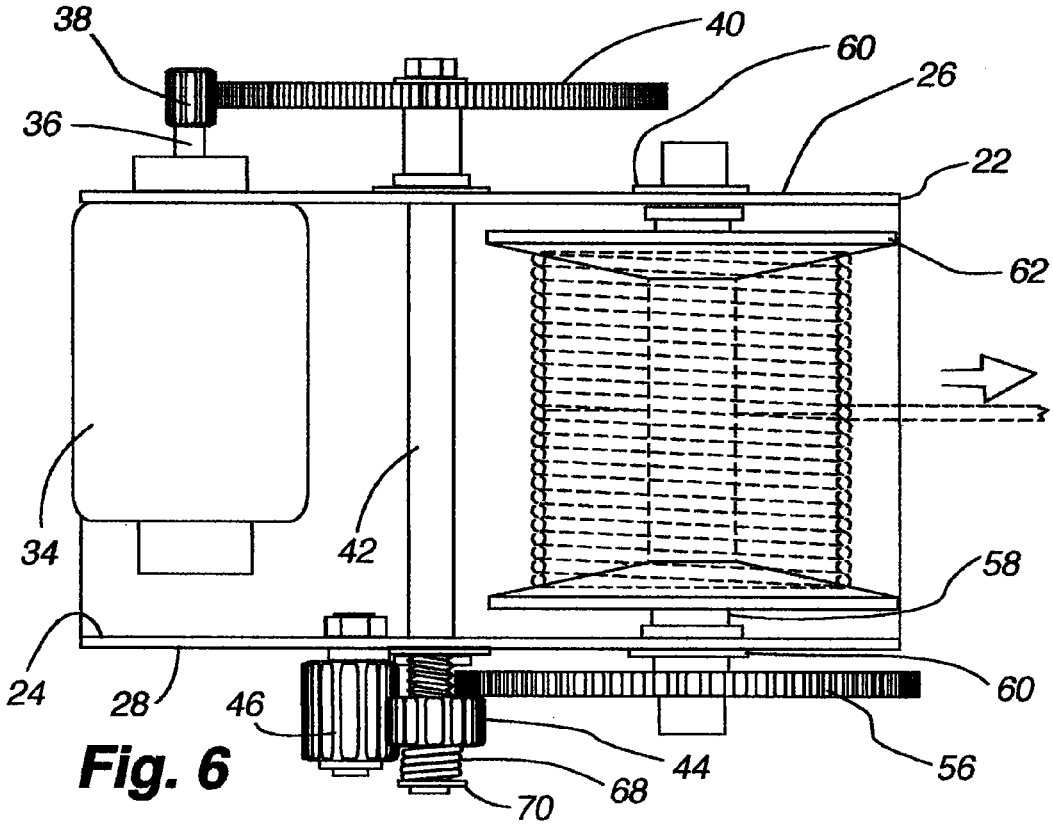
FIG. 6 is a top plan view similar to FIG. 5 with the clutch gear in a payout position.
Figure 7:
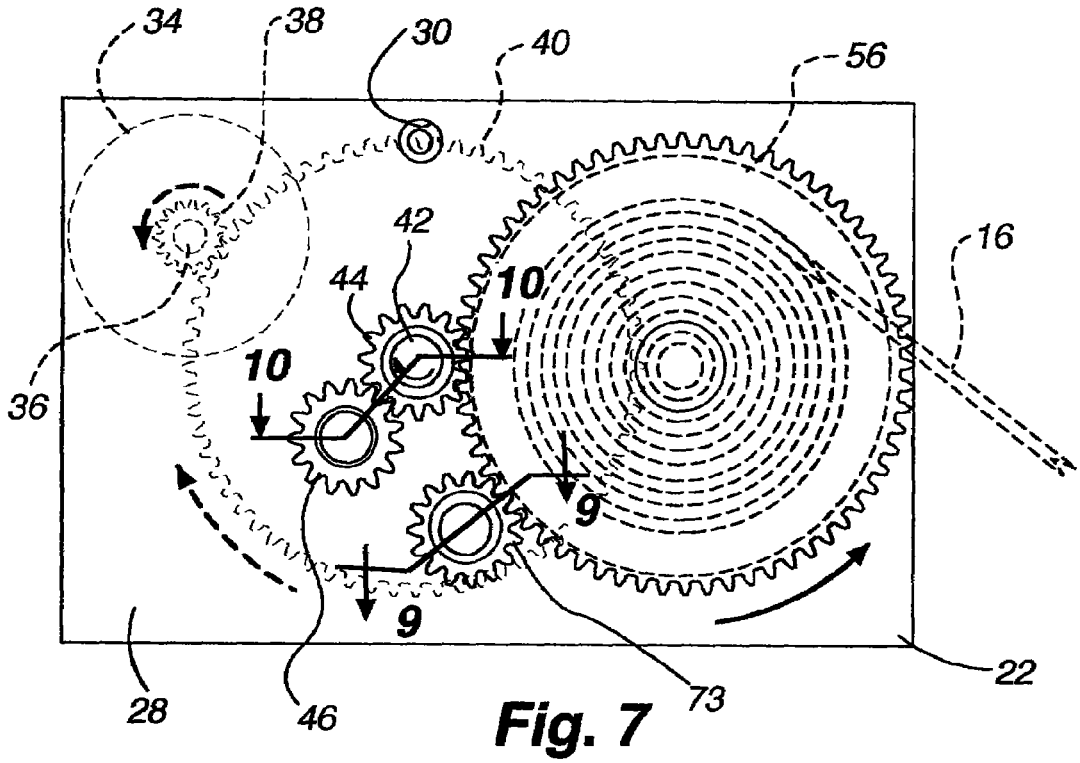
FIG. 7 is a right side elevation similar to FIG. 4 with the motor being driven in a retrieve direction.

The clutch gear 44 is selectively engageable with a spool gear 56 as will be described in more detail hereafter wherein the spool gear, as possibly best seen in FIGS. 5 and 6, is mounted on a transverse shaft 58 to which it is keyed or splined for unitary rotation therewith. The transverse shaft is mounted in bearings 60 in the left 26 and right 28 side walls of the frame 22 so as to be freely rotatable therein and carries a spool 62 also splined or keyed to the transverse shaft for unitary rotation therewith. Accordingly, as the spool gear rotates so does the spool 62 mounted between the left and right side walls on the transverse shaft 58.

The spool 62 anchors one end of the flexible anchor cable 16 which can be wrapped on or unwrapped from the spool depending upon the mode of operation of the motor, i.e. whether it is in a retrieve or payout mode. In a retrieve mode, the cable is wrapped around the spool whereas in a payout mode it is unwrapped from the spool.

Figure 10:
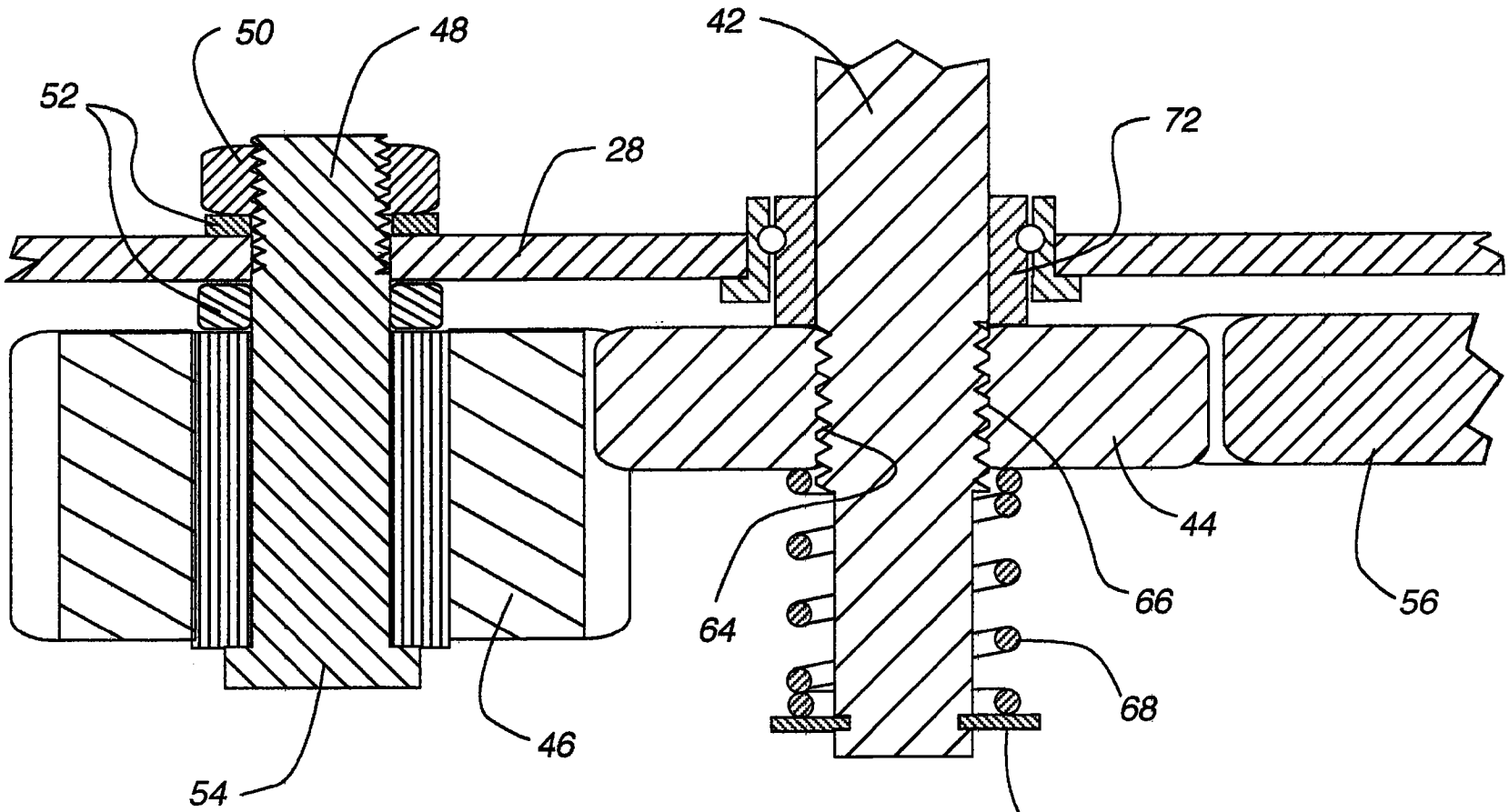
FIG. 10 is an enlarged fragmentary section taken along line 10—10 of FIG. 7.
Figure 11:
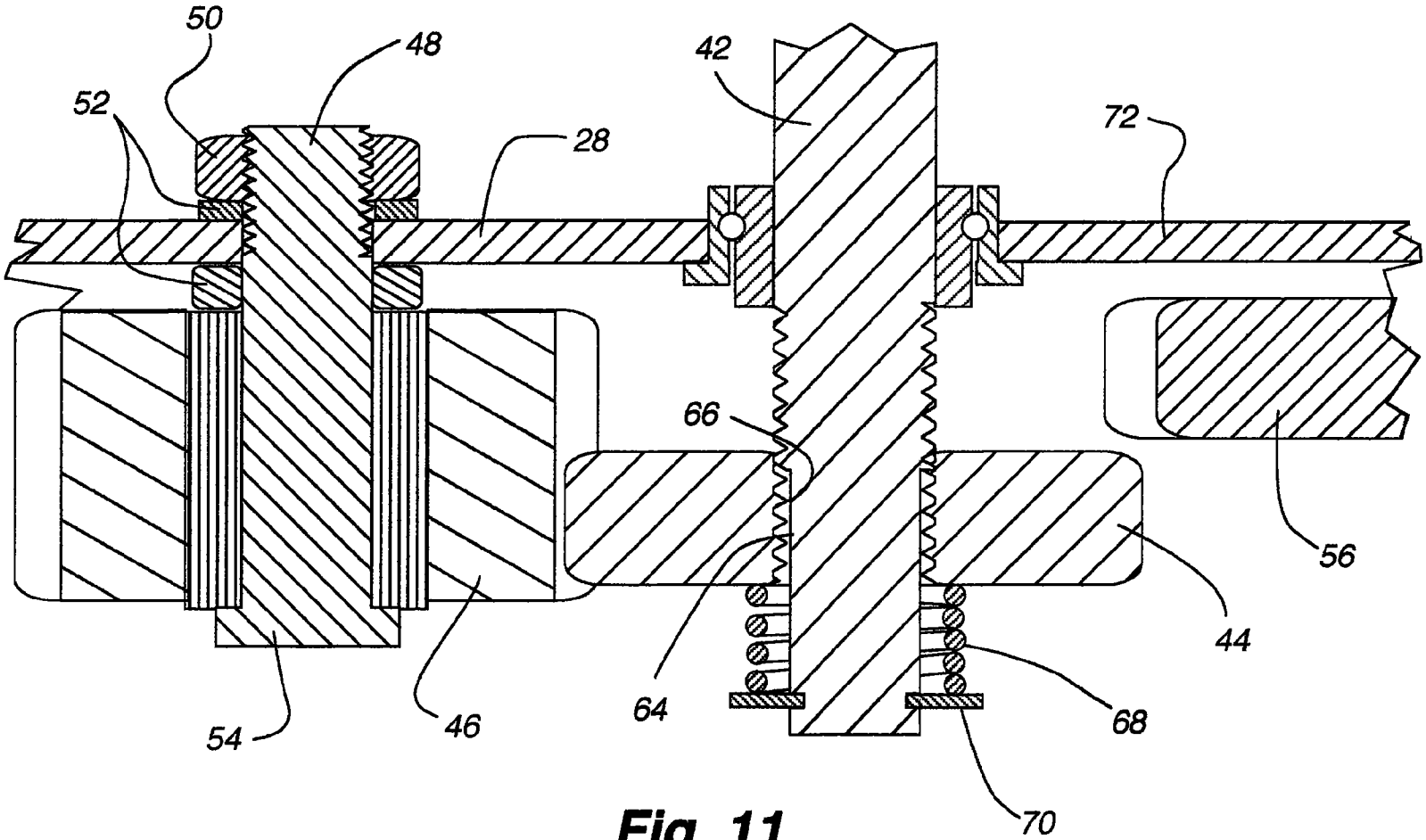
FIG. 11 is an enlarged fragmentary section taken along line 11—11 of FIG. 8.

With particular reference to FIGS. 10 and 11, it will be seen that the transfer shaft 58 has threads 64 spaced inwardly from its right end with the threads receiving internal threads 66 on the clutch gear 44. The threads 64 and 66 are oriented so that when the motor 34 is driven in a retrieve direction, the clutch gear is forced to move left (as viewed from the front of the winch) toward the outer surface of the right side wall 28, whereas when the motor is driven in a payout direction, the clutch gear is forced to move away from the right side wall. A coil spring 68 is mounted on the transfer shaft outwardly of the clutch gear and is seated against a C-clamp 70 mounted on the right end of the transfer shaft. The coil spring assures that the clutch gear remains in threaded engagement with the transfer shaft for desired movement relative to the transfer shaft.

Figure 4:
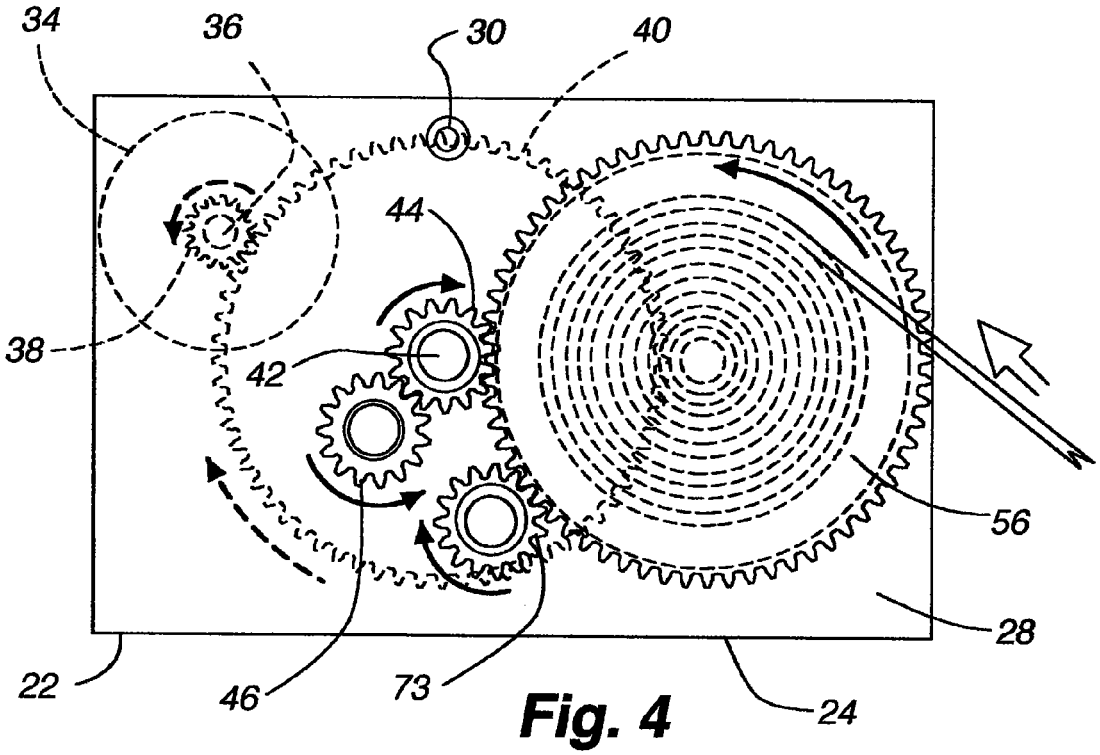
FIG. 4 is a right side elevation of the components of the windlass shown in FIG. 3.

In operation of the windlass, when the motor 34 is driven in a retrieve direction as shown in FIGS. 4, 5 and 10, the transfer shaft 58 is rotated by the spur gear and the meshed transfer gear 40 causes the clutch gear 44 to shift to the left or toward the right side wall 28. As mentioned previously, the coil spring 68 assures that the clutch gear remains in threaded engagement with the transfer shaft so that rotation of the transfer shaft in the retrieve direction will cause the clutch gear to shift to the left until it engages the bearing 72 supporting the transfer shaft in the right side wall. Once the clutch gear engages the bearing, it is forced to rotate in unison with the transfer shaft. It is also meshed with the spool gear 56 so as to rotate the spool 62 in a retrieve direction as seen for example in FIGS. 4, 5, and 7. It is also important to note that the clutch gear 44 remains in contact with the control gear 46 throughout its axial movement along the transfer shaft so that the control gear continues to rotate in unison with the clutch gear.

Figure 8:
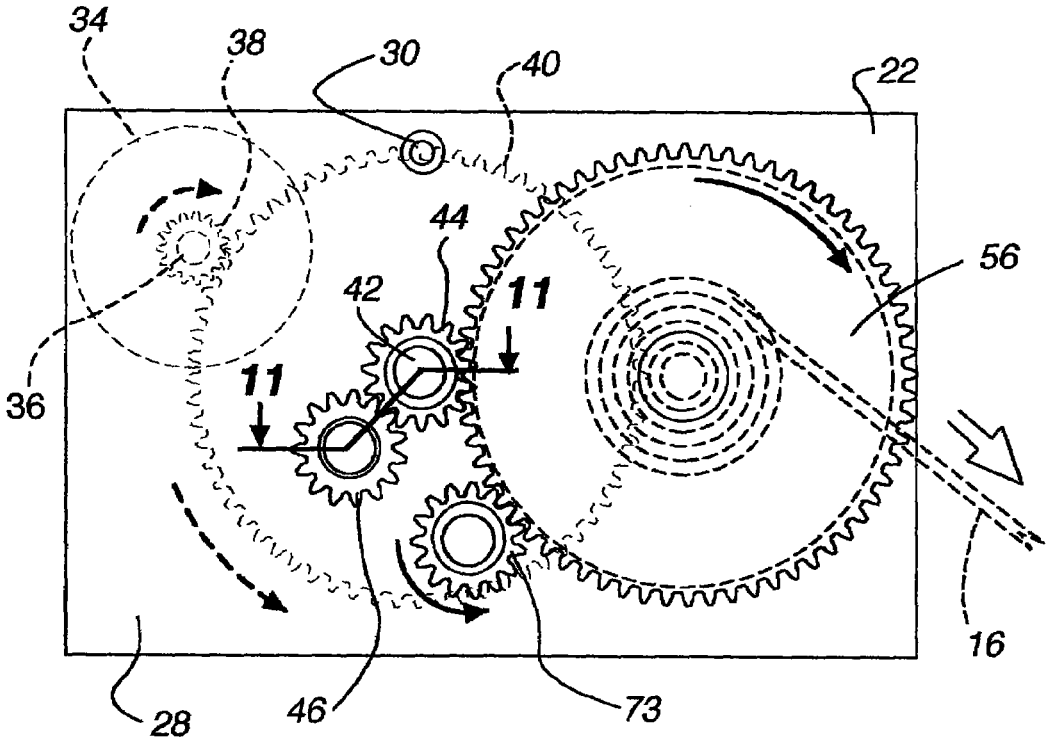
FIG. 8 is a right side elevation similar to FIG. 7 with the motor being driven in a payout direction.

Reverse rotation of the motor 34 in the payout direction illustrated in FIGS. 6, 8, and 11 causes the clutch gear 44 to be shifted away from the right side wall 28 toward the end of the transfer shaft and against the bias of the coil spring 68 until the clutch gear reaches the position shown in FIG. 11. In this position, while the clutch gear begins to rotate with the transfer shaft, if the transfer shaft continues to be driven by the motor, it is disengaged from the spool gear 56 so that the spool gear 56 is free to rotate independently of the other afore-described gears and the motor of the windlass. It is of course in this position that the anchor can be allowed to drop by gravity causing the spool gear to rotate in unison with the spool 62 as the anchor cable is paid out from the spool. As mentioned previously, the description of the windlass at this point, while being slightly structurally different from the windlass described in the aforenoted U.S. Pat. No. 4,809,633, operates in a very similar manner.

Figure 9:
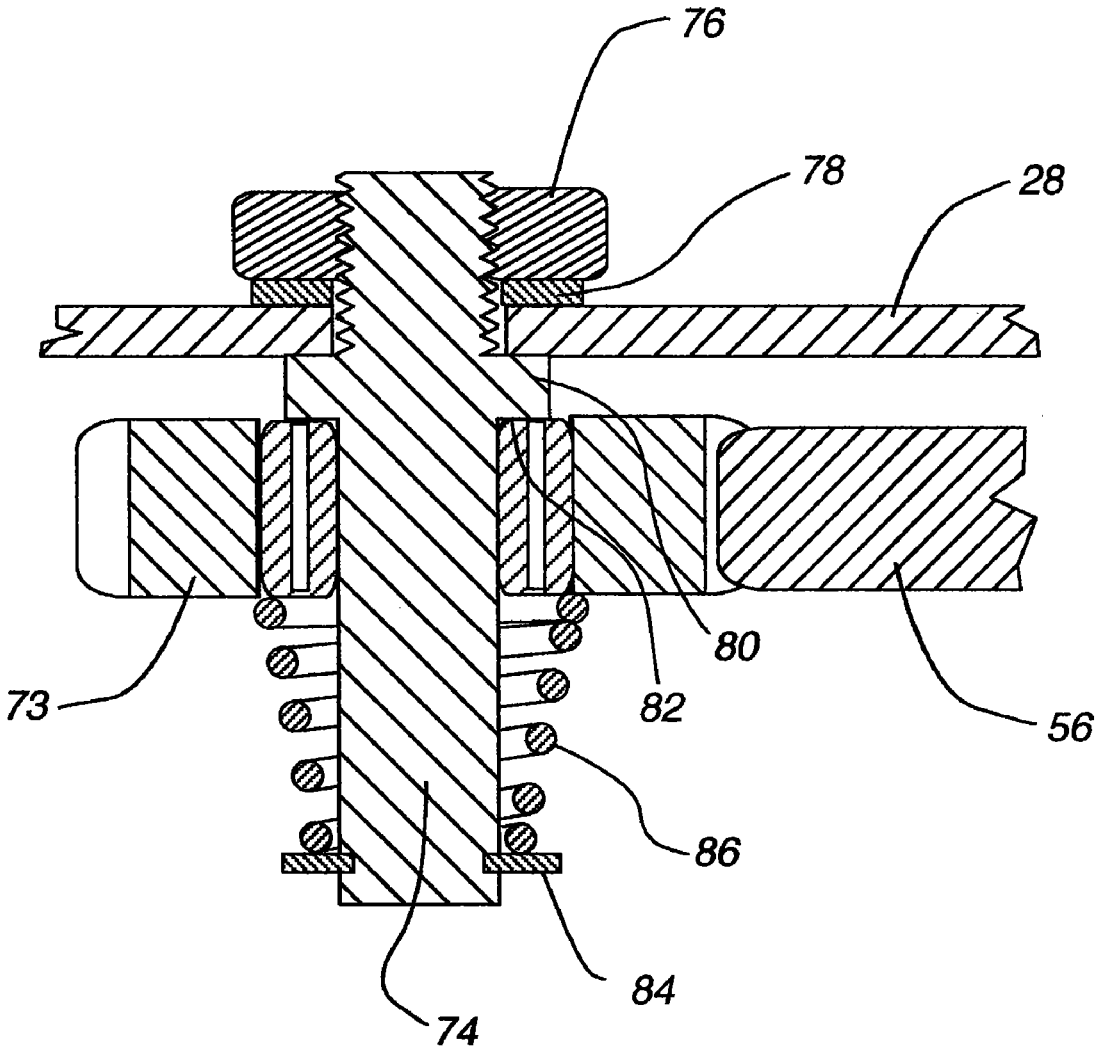
FIG. 9 is an enlarged fragmentary section taken along line 9—9 of FIG. 7.

To control the payout of the anchor cable 16 from the spool 62 and avoid entanglement of the cable as discussed previously if the cable begins to payout faster than the spool is rotating, a governor gear 73 has been mounted on the outside of the right side wall in meshed engagement with the spool gear 56. The governor gear seen probably best in FIG. 9 is mounted on a stub shaft 74 held on the right side wall 28 of the frame with a nut 76 and washer 78. The stub shaft has an enlarged peripheral flange 80 defining an outer shoulder 82 adjacent to the right side wall and a C-clamp 84 secured to its outer end. The C-clamp seats a compression spring 86 that engages the outer surface of the governor gear biasing the governor gear toward the shoulder 82 on the stub shaft. The governor gear therefore frictionally engages the shoulder and the strength of the compression spring determines the degree of such friction which of course inhibits and controls the rotation of the governor gear about its stub shaft. Obviously, the stronger the compression spring 86 the more friction and resistance to rotation of the governor gear. The compression spring can be easily interchanged by removing the C-clamp for springs of different strengths depending on the resistance desired for payout rotation of the spool.

The governor gear 73 is always in meshed relationship with the spool gear 56 and therefore has a bearing on the rate at which the spool gear 56 will rotate. The strength of the compression spring is preselected so that it does not inhibit operation of the motor 34 and the motor can turn the spool gear in either direction, but when the motor and clutch gear 44 are disengaged from the spool gear and it is free to rotate such as in a freefall of the anchor, the governor gear controls the rate at which the spool 62 can rotate thereby maintaining control of the anchor cable 16 as the anchor is dropping by gravity. By controlling the rate of rotation of the spool through its spool gear the governor prevents entanglement of the anchor cable.

In accordance with the above, it will be appreciated that operation of the motor in a retrieve mode causes the clutch gear 44 to shift toward the right side wall 28 into engagement with the spool gear 56 causing the spool gear to rotate in a retrieve direction as shown in FIGS. 4, 5, and 10. Of course, the motor is driven in a retrieve direction until the anchor has reached a desired elevation and then the motor is switched into a deactivate mode.

Operating the motor in the reverse payout direction for a short period of time causes the clutch gear 44 to move from its engaged position with the spool gear 56 of FIG. 10 to its disengaged position of FIG. 11 so that the spool gear and the operatively interconnected spool 62 are free to rotate allowing the anchor to drop by gravity. The governor gear 73, however, inhibits and governs the rate at which the spool gear can rotate and consequently the spool itself and therefore the rate at which the anchor drops by gravity so that the anchor cable is controlled and entanglement is avoided.

Although the present invention has been described with a certain degree of particularity, it is understood the disclosure has been made by way of example, and changes in detail or structure may be made without departing from the spirit of the invention as defined in the appended claims.

The invention claimed is:

1. A windlass comprising in combination:

a frame;

a reversible motor mounted on the frame, said motor having a drive shaft with a gear thereon;

a rotatable spool with a cable wrappable thereon and unwrappable therefrom mounted on said frame, said cable having a free end with a weighted objected thereon;

a spool gear operably connected to said spool for unitary rotation therewith;

a gear train mounted on said frame establishing selectable operative engagement between said motor and said spool gear such that said spool gear can be rotated in a first direction with said motor and rotated in a second direction independently of said motor and gear train; and a governor for inhibiting rotation of said spool gear when it is independent of said motor and gear train, said governor including a governor gear mounted on said frame independently of said motor and gear train, said governor gear being meshed with said spool gear to rotate in unison therewith, and said governor gear including means for inhibiting its rate of rotation in the form of a spring for frictionally engaging said governor gear with a friction surface.

2. The windlass of claim 1 wherein said spring is interchangeable.

3. The windlass of claim 2 wherein said governor gear is in continuous meshing engagement with said spool gear.

* * * * *